US005165111A

United States Patent [19]

Lieberman

[11] Patent Number: 5,165,111

[45] Date of Patent: Nov. 24, 1992

[54] BACKPACK WITH INTEGRAL GARMENT

[76] Inventor: Richard A. Lieberman, 12400 Clayton Rd., St. Louis, Mo. 63131

[21] Appl. No.: 840,508

[22] Filed: Feb. 24, 1992

[51] Int. Cl.[5] ..... A41D 1/02; A41D 1/04

[52] U.S. Cl. ..... 2/94; 2/88; 2/108

[58] Field of Search ..... 2/84, 86, 88, 89, 94, 2/108; 224/151, 153; 383/4

[56] References Cited

U.S. PATENT DOCUMENTS

| | | | |
|---|---|---|---|
| 2,248,455 | 7/1941 | Freund . | |
| 4,389,735 | 6/1983 | McLaughlin . | |
| 4,475,251 | 10/1984 | Hopkins | 2/94 |
| 4,476,587 | 10/1984 | Itoi | 2/94 |
| 4,502,155 | 3/1985 | Itoi | 2/94 X |
| 4,563,777 | 1/1986 | Park . | |
| 4,637,076 | 1/1987 | Tartt et al. | 2/94 X |
| 4,689,831 | 9/1987 | Greenberger et al. . | |
| 4,700,409 | 10/1987 | De Lott | 2/94 |
| 4,949,401 | 8/1990 | Kimsey, Jr. | 2/102 |

FOREIGN PATENT DOCUMENTS

| | | | |
|---|---|---|---|
| 2948713 | 6/1981 | Fed. Rep. of Germany | 224/153 |
| 2553981 | 5/1985 | France | 224/153 |

*Primary Examiner*—Werner H. Schroeder
*Assistant Examiner*—Jeanette Chapman
*Attorney, Agent, or Firm*—Kalish & Gilster

[57] ABSTRACT

A backpack having an integral garment includes a container portion having front, central and rear panels. Straps are attached to the front panel for support of the backpack from the wearer's shoulders. The front panel is releasably connected to the central panel for access to an internal compartment formed continuously along the central panel on the inside of the container portion for storage therein of an integral garment. The integral garment may be withdrawn from the storage compartment and donned by the wearer of the backpack without removal thereof from the wearer's shoulders, the garment at all times remaining in integrated relationship with the backpack.

13 Claims, 5 Drawing Sheets

BACKPACK WITH INTEGRAL GARMENT

BACKGROUND AND SUMMARY OF THE INVENTION

The present invention relates generally to the field of backpacks and, more specifically, to a backpack having a compartment containing an integral garment which may be donned by the wearer of the backpack at will, without prior removal of the backpack from the body.

Ordinarily, the wearer of a backpack who encounters inclement weather must don a very large, cumbersome garment, such as a poncho, to cover both the wearer and the independent (unattached) backpack. Alternatively, the wearer must completely remove the backpack to put on a jacket and then place the backpack on the shoulders over the jacket, leaving the straps exposed to the weather. The latter arrangement can become quite uncomfortable as the garment becomes bunched or wrinkled between the body and the pack. Moreover, it may also require adjustment of the shoulder straps in order to permit the proper fit over the jacket.

Previous attempts to address this problem include U.S. Pat. No. 2,248,455, issued to Freund, which discloses a coat and a removable knapsack combination, whereby the knapsack can constitute a carrying case or bag for the coat when the latter is detached from the knapsack. The coat is provided with straps secured at the lower ends thereof on the inside of the coat. The straps have upper portions which pass through slits in the shoulders of the coat for retention of position. Outer free-end portions of the straps pass through loops positioned adjacent to side edges of the knapsack for fastening thereto and for adjustment to support the knapsack as desired by the wearer to relieve the coat at least in part of stress imposed by the weight of the knapsack. The coat can then be worn as a garment separate from the knapsack by disengagement of various stringers, fasteners and straps included in the arrangement.

An alternative convertible garment is disclosed in U.S. Pat. No. 4,689,831 issued to Greenberger et al, wherein a pocket is provided on the back of a garment for carrying small items and for serving to store the folded garment when it is not being worn. The pocket or bag must be inverted for the garment to be removed therefrom and placed on the body of the person who chooses to wear it. The garment of the Greenberger patent has straps fastened into the side seams thereof and openings in the inside sleeve seam to enable the sleeve to be rolled up and tucked into the garment. The garment is then pushed through the back portion of the pocket as the openings of the pocket are pulled around the garment such that the pocket is turned inside out with the garment packed inside.

U.S. Pat. No. 4,563,777 to Park and earlier U.S. Pat. No. 4,389,735 to MacLaughlin each describe combination backpack/jackets in which, when it is desired to wear the jacket, the pack is removed from the body and a flap closure is opened to remove a garment from inside a compartment of the backpack which is adjacent the wearer's back when the pack is being worn. After putting the garment on, the straps of the backpack are placed around the wearer's shoulders over the garment. The latter construction requires more bulk to be carried against the wearer's back when the garment is within the backpack and is inconvenient at best; and at worst, the garment may be altogether inaccessible, depending upon the conditions in which it is worn. Such construction is particularly difficult for small children who may have difficulty in removing a full pack and replacing it without assistance.

None of the known bag or pack and garment combinations teach a backpack having an integral garment and being constructed so that the backpack portion has the general outward appearance of an ordinary book bag or "day pack", and yet also has the garment portion stored therein in such a manner that it can be readily removed from its storage place and placed over the pack's straps and the wearer's body without prior removal of the pack by the wearer and without complete separation of the garment from the pack.

Accordingly, it is among the objects of the present invention to provide a backpack having an integral garment which is simply and quickly donned by the wearer of the backpack without requiring removal thereof from the user's body.

It is another object of the present invention to provide a backpack having the above features which is simple in construction and well adapted for mass production as well as being reliable in use.

It is a further object of the present invention to provide a backpack having the above features which is not bulky, but is comfortable to the wearer and in which the integral garment is securely attached to the backpack and does not bear the weight of the pack, for extended useful life of the entire combination.

It is yet another object of the present invention to provide a backpack of the character stated which is capable of being presented in any available color, with or without printed matter (such as, for example, a school logo or team insignia), in a variety of fabrics or other flexible, sheet-like materials, in at least several different overall shapes, and is provided with an integral garment chosen from a wide selection thereof.

In furtherance of these objects, the present invention is, briefly, a backpack having an integral garment which may be donned by the wearer of the backpack without removal thereof, the backpack has container portion including a front panel having a perimeter, a central panel having a continuous front edge and a continuous rear edge, and a rear panel having a perimeter. The central panel intersects and connects the front panel and the rear panel and forms therebetween top, first and second side and bottom external walls. The front panel further has a plurality of straps connected thereto for support of the backpack from the wearer's shoulders. The backpack is also adapted for releasably connecting the front panel along the perimeter thereof to the front edge of the central panel. A garment portion integrally connects to the container portion, and the backpack is adapted for storing the integrally connected garment portion in the container portion in such manner that the garment can be selectively donned by the wearer without removal of the container portion from the wearer's shoulders.

The invention is further, briefly, provided with an adaptation for storing the garment portion which is an openable tubular shaped storage compartment which extends continually internally along the inside of the central panel of the container portion for storage therein of the garment when not being worn.

The invention is yet further, briefly, adapted for selectively releasably connecting the front panel to the central panel, which adaptation is a zipper having first and second intermeshing tracks, the zipper being connected coextensively along the first track to the entire perimeter of the front panel, and being connected simultaneously and coextensively along the second track to the back of the garment portion and to the front edge of the central panel to thereby provide access to the storage compartment by the wearer for removal of the garment from the storage compartment and donning of the garment by the wearer without removal of the container portion from the wearer's shoulders.

Other objects and features will be in part apparent and in part pointed out hereinbelow.

DESCRIPTION OF PRACTICAL EMBODIMENTS

Figure 1:
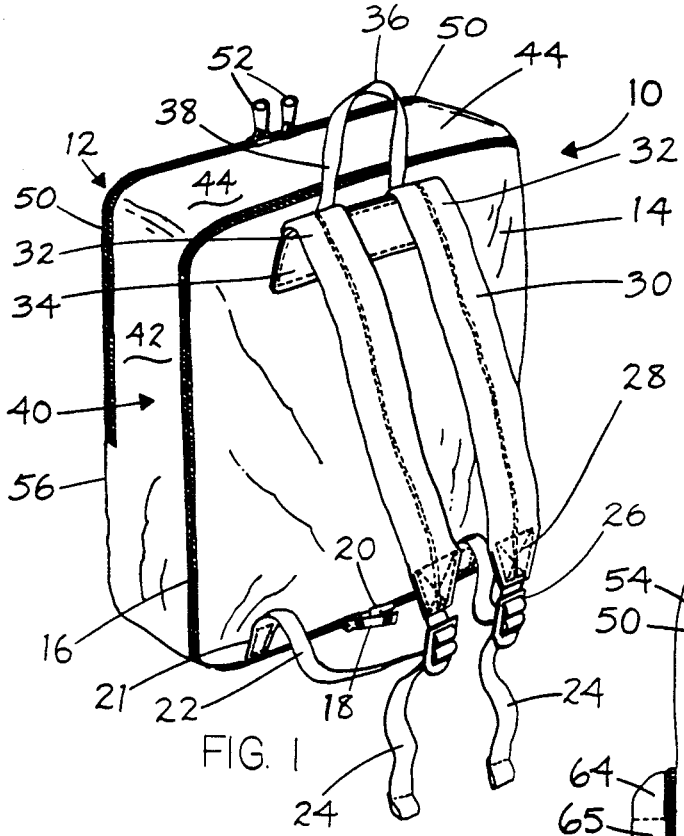
FIG. 1 is a perspective view of a first embodiment of a backpack constructed in accordance with and embodying the present invention, with the integral garment thereof in stored position.
Figure 2:
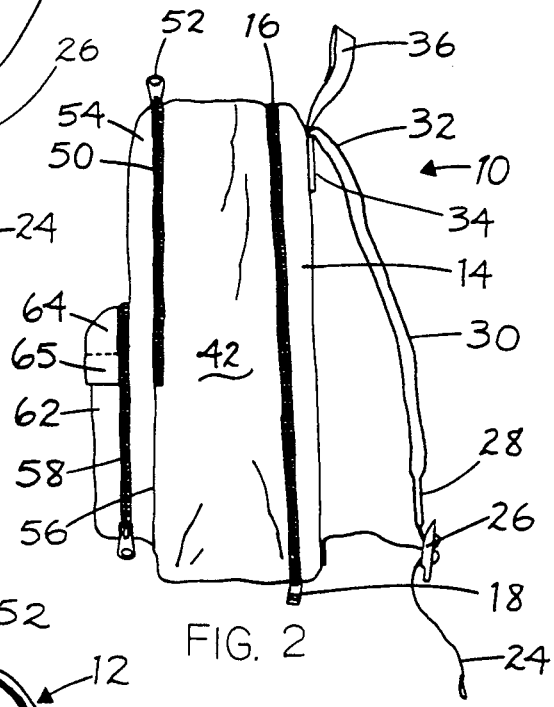
FIG. 2 is a side elevational view of the backpack of FIG. 1.
Figure 3:
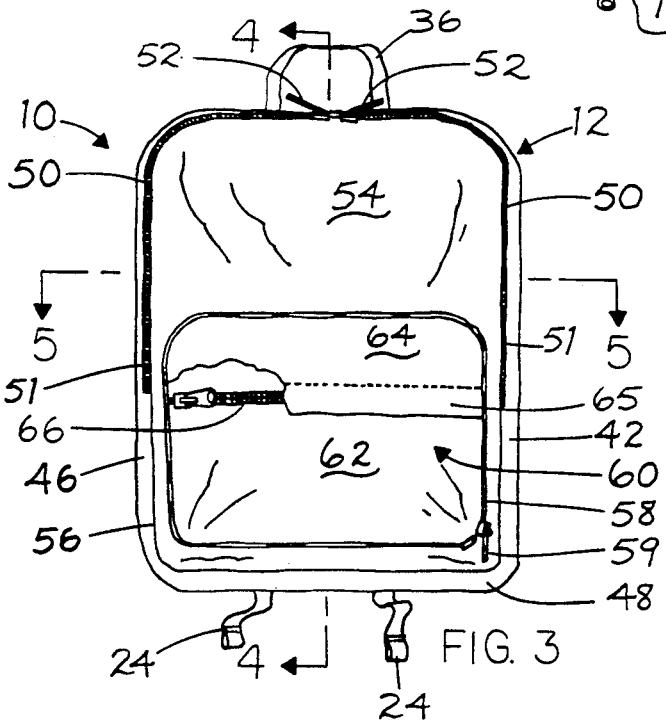
FIG. 3 is a rear elevational view of the backpack of FIG. 1.

With reference to the Figures, 10 generally designates a first embodiment of the new backpack, which,. for simplicity of discussion, is usually referred to as pack 10. FIGS. 1 through 3 illustrate that in closed position pack 10 has a general appearance much like that of an ordinary backpack for hands-free transport of books, camping equipment or other heavy or bulky items and is optionally adapted for convenient carriage of smaller loose items as well. Pack 10 is generally constructed of interconnected front, central and rear panels and has an integral garment which may be secreted in a compartment formed internally of the central panel, but appears as a normal garment when worn, all as described more fully hereafter.

In this first embodiment, pack 10 is constructed so as to have a substantially squared-off shoulder portion 12, providing the backpack of a generally rectangular contour. A substantially rectangular front panel 14 is desire ably completely encompassed along the perimeter thereof by a zipper 16 having a single zipper tab 18 and end 20, both located preferably at the center bottom of front panel 14 when zipper 16 is in fully closed position, as seen in FIGS. 1 and 2. Zipper 16 has two elongated intermeshing tracks 16', 16'', the function of which is described hereafter in regard to FIGS. 4–5A.

Securely attached as, for example, by stitching at the base of front panel 14 inwardly adjacent to the perimeter thereof and spacedly outward to each side of closed zipper tab 18 are ends 21 of a pair of adjustment straps 22. Free ends 24 of adjustment straps 22 are threadedly engaged to adjustment buckles 26. Adjustment straps 22 are preferably formed of a strong, water resistant material such as woven nylon for extended wear.

Adjustment buckles 26 are each engaged by a free end 28 of one of a pair of preferably padded shoulder straps 30. Upper ends 32 of shoulder straps 30 are attached as, for example, by stitching to front panel 14 adjacent to the upper perimeter thereof. Securement of strap ends 32 is optionally ensured by provision of a reinforcing member 34, such as a strip of tough plastic or rubber, which is attached in overlaying fashion as by stitching to support upper ends 32 against front panel 14.

An optional loop 36 for hanging or holding pack 10 is also attached at opposed ends 38 thereof between reinforcing member 34 and front panel 14.

Although the above-described type and arrangement of straps 22, 30, loop 36 and buckles 26 is preferred, other conventional substitutes therefor will adequately suffice. However, it is critical to the proper function of pack 10 that all strap ends 21, 32 and reinforcing member 34 are attached to front panel 14 within the outer perimeter thereof as bounded by zipper 16, so as not to interfere with the action of zipper 16 or access thereto by the wearer.

Figure 4:
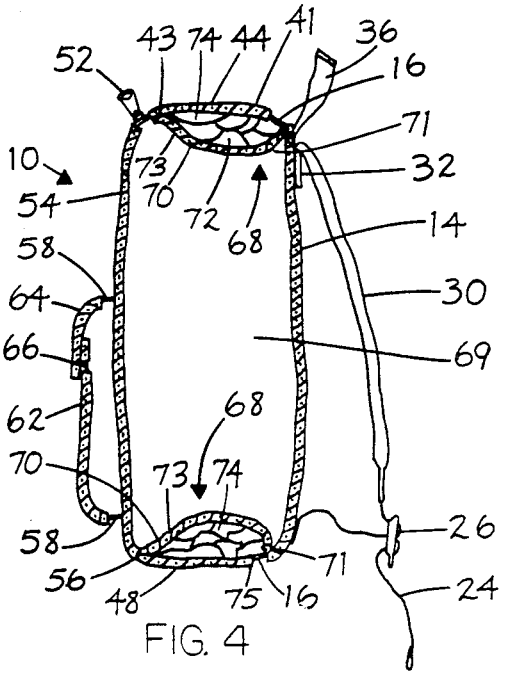
FIG. 4 is a longitudinal sectional view taken on line 4—4 of FIG. 3.
Figure 5:
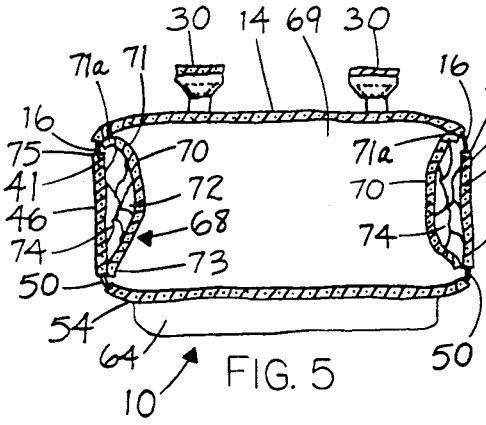
FIG. 5 is a transverse sectional view taken on line 5—5 of FIG. 3.

When pack 10 is in closed position, as in FIGS. 1–5, extending substantially perpendicularly rearwardly from front panel 14 and connected thereto by zipper 16 is a central wall (or panel) 40, attached entirely along a front edge 41 thereof. Central wall 40 is composed of right side wall 42 which extends upward and continues to become top wall 44 which latter passes across the entire width of pack 10 and flows downwardly into left side wall 46, which in turn continues to extend laterally beneath pack 10 as lower or bottom wall 48 (FIGS. 4 and 5). Side walls, 42, 46 provide an ideal space for placement of printed material such as a sports team's logo, if desired.

When connected as described, zipper 16 provides access to the garment storage compartment formed internally of the central panel, as more fully described hereafter. Alternatively, front panel 14 and central panel 40 may be connected, as, for example, by a line of stitching. In that case, zipper 16 would be placed more rearwardly on central panel 40. Such structure would function adequately, but would interrupt any printed matter (not shown) optionally provided on panel 40.

Approximately the upper half of continuous central wall 40 is connected along a back edge 43 thereof to a substantially rectangular, normally upright rear panel 54 by paired zippers 50 having ends 52 which as shown meet centrally upwardly on back panel 54 and rearwardly on top panel 44 when zippers 50 are closed. Rear or back panel 54 is substantially the same in size and shape as front panel 14 and is approximately parallel thereto. A preferably stitched seam 56 extends between lower ends 51 of zippers 50 and continues the connection of rear panel 54 to central panel 40 along back edge 43 at the approximate lower halves thereof. So connected, front panel 14, central panel 40 and rear panel 54 define a relatively large compartment of pack 10 for containing books, boots or other various objects, as desired.

Rearwardly of back panel 54 is a smaller compartment or pocket 60 for containing such items as pens, pencils and the like. Pocket 60 is securely but removably attached, preferably to the lower half of rear panel 54, by an encompassing zipper 58 which is provided with a single end tab 59 and which extends entirely around the forward contour of pocket 60. The zipper 58 connection of pen pocket 60 to back panel 54 of pack 10 permits the optional use or detachment thereof. Pocket 60 preferably includes a lower pouch portion 62 topped by a generally horizontal flexible cover 64 which is attached thereto by zipper 66. Flexible cover 64 extends along a lower edge thereof into a narrow flap 65 which overlays zipper 66 for protection from the elements.

Although the described structure and attachment of pocket 60 are preferred, other constructions will suffice. In fact, pocket 60 may be permanently affixed to pack 10, or eliminated entirely, without interferring with the structure and function of the integral garment and backpack combination of the invention as further described below.

FIGS. 4 and 5 illustrate that a tubular or channel-like storage compartment, generally designated 68, is formed by preferably stitched attachment of an inner wall 70 coextensively with and inside of central panel 40 for containment of the garment portion, generally designated 74, of backpack 10. Inner wall 70 preferably attaches continuously along a forward edge 71 thereof by a line of stitching 71*a* to the entire perimeter of front panel 14 and to one track 16″ of zipper 16. When zipper 16 is closed inner wall 70 simultaneously attaches entirely along zipper 16 to central panel 40, such that zipper 16 provides access to storage pouch 68. Inner wall 70 attaches continuously along a rearward edge 73 thereof to central panel 40, adjacent to and coextensively with zipper 50 and seam 56, so as to be unopenably sealed entirely along rear edge 73. So constructed, inner wall 70 at all times forms a partition between compartment 68 and the interior 69 of containers 76 of pack 10.

Figure 5A:
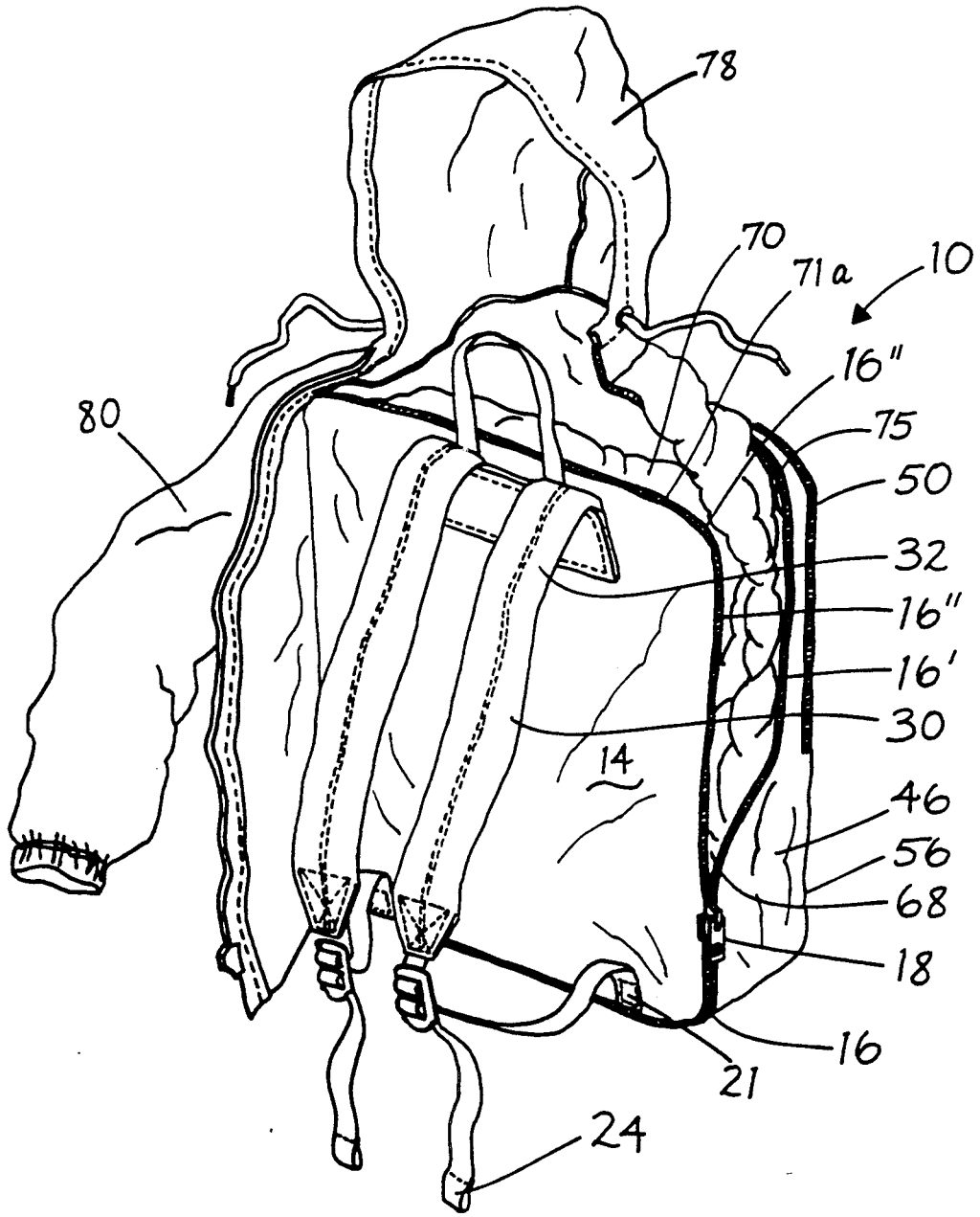
FIG. 5A is a front perspective view of the backpack of FIG. 1 with the garment partially removed from its storage compartment.

As seen in FIG. 5A, when zipper 16 is open, front panel 14 remains connected to the rest of pack 10 by the previously discussed forward seam 71*a* which secures front panel 14 at the perimeter thereof to inner wall 70. When zipper 16 is closed, weight of the pack contents (not shown) is transferred from central panel 40 via zipper 16 to front panel 14, but when zipper 16 is open, weight is transferred to front panel 14 and straps 30 via inner wall 70 which is connected as described to front wall 14 along seam 71*a*.

Figure 6:
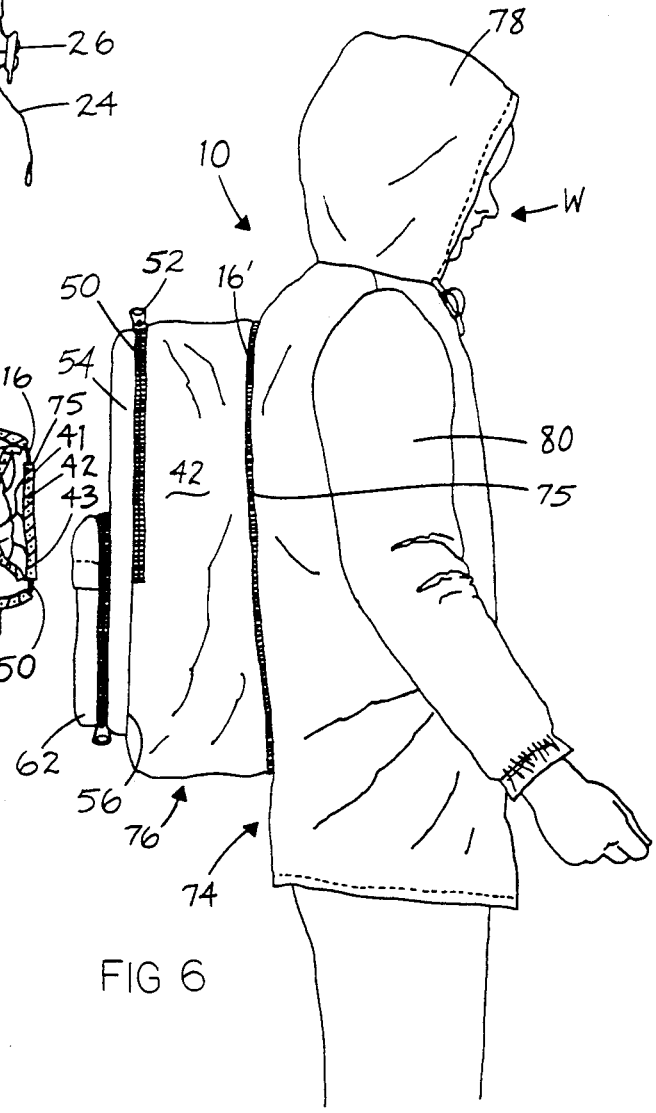
FIG. 6 is a side elevational view of the backpack of FIG. 1 with the garment and backpack in operational position on a wearer.
Figures 7, 8, 9:
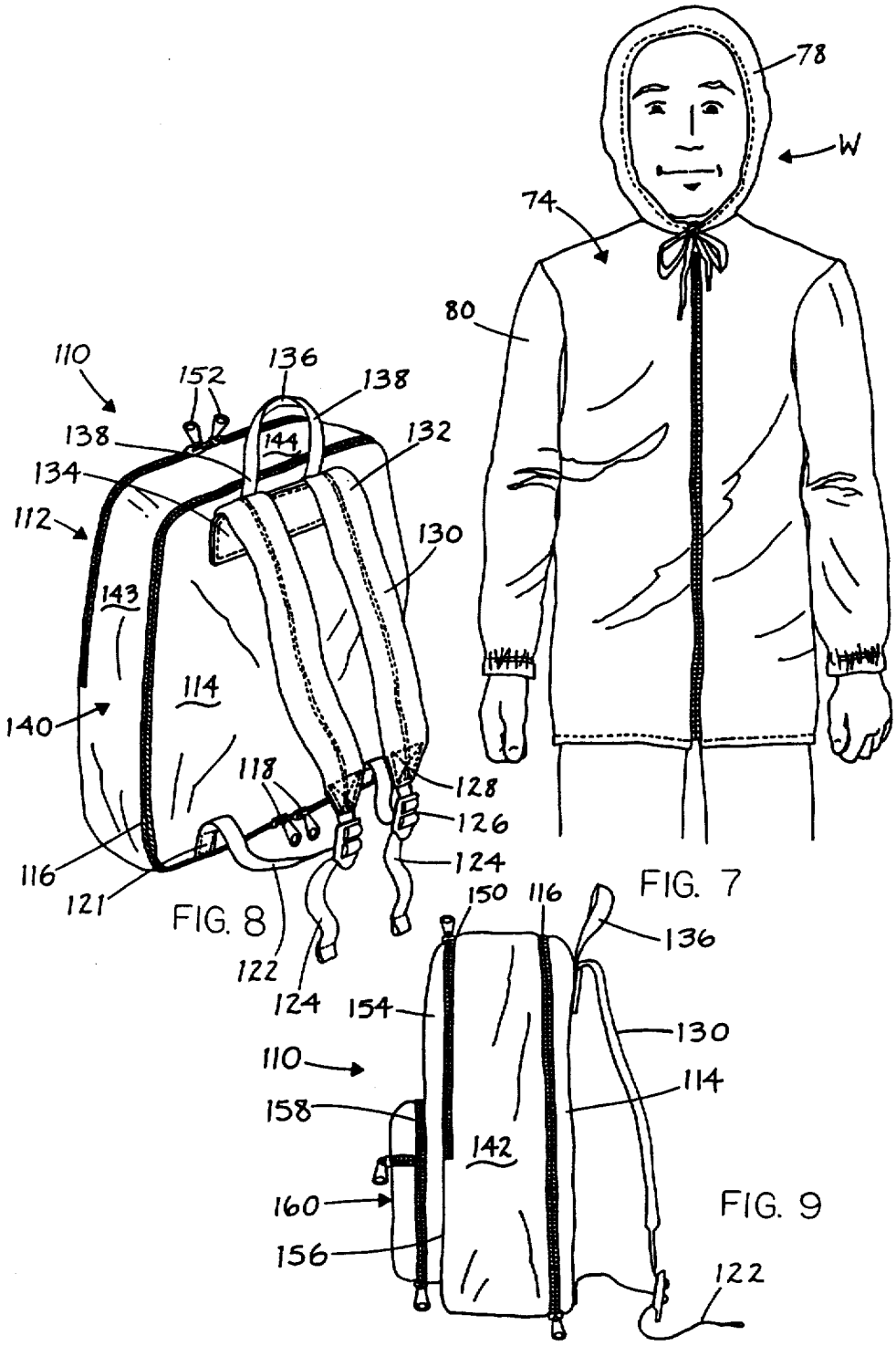
FIG. 7 is a front elevational view of the wearer of the backpack shown in FIG. 6.
FIG. 8 is a perspective view of a second embodiment of a backpack constructed in accordance with and embodying the present invention, with the integral garment thereof in stored position.
FIG. 9 is a side elevational view of the backpack of FIG. 8.

FIGS. 6 and 7 illustrate that in operable position with garment 74 on wearer W only one track 16′ of zipper 16 is visible. Track 16′, as explained, is connected simultaneously, along with front edge 41 of panel 40 and the back of garment 74 along seam 75. Support straps 30 and the other zipper track, 16″ are completely hidden from view, being covered by garment 74. FIG. 5A makes clear how this occurs. As shown in this embodiment garment 74 preferably consists of a jacket having an optional hood 78 and full sleeves 80. Track 16, and the back of garment 74 are both connected to front edge 41 of central panel 40 along the same continuous seam 75 so that front panel 14 of the attached container portion 76 fills in or effectively forms a cover for what would otherwise be a hole or cut-out in the back of garment portion 74. Although seam 75 is preferably stitched, for strength, as with all other seams in pack 10, other methods of forming the seams, such as melting by heat or chemicals, or gluing are conceivable.

If zipper 16 is provided more rearwardly on central panel 40 such structure will function as required. However, cosmetically, this structure may not be as desirable as having zipper 16 coextensive with seam 75, as shown, because any printed matter on panel 40 could be at least partially obscured when garment 74 is in wearing position.

When wearer W has pack 10 shoulder mounted in closed operable position, it is a simple matter to completely release zipper 16 thereby opening compartment 68 entirely for easy access to space 72 and partial removal of garment 74. Thus, without removing the container portion, generally designated 76, of pack 10, the garment portion 74 may be easily withdrawn from compartment 68 and then drawn up over the body.

Although many flexible, sheet-like materials obviously will suffice for construction of pack 10, it is usually desirable that both the garment portion 74 and the container portion 76 are composed of an at least water-resistant, if not water-impermeable material.

FIGS. 8 through 12 illustrate a second preferred embodiment, generally designated 110, of the new convertible backpack/garment. Pack 110 bears much similarity in all important structural and functional aspects to pack 10, previously described, and thus like parts are similarly numbered but carry the digit prefix 1.

Figure 10:
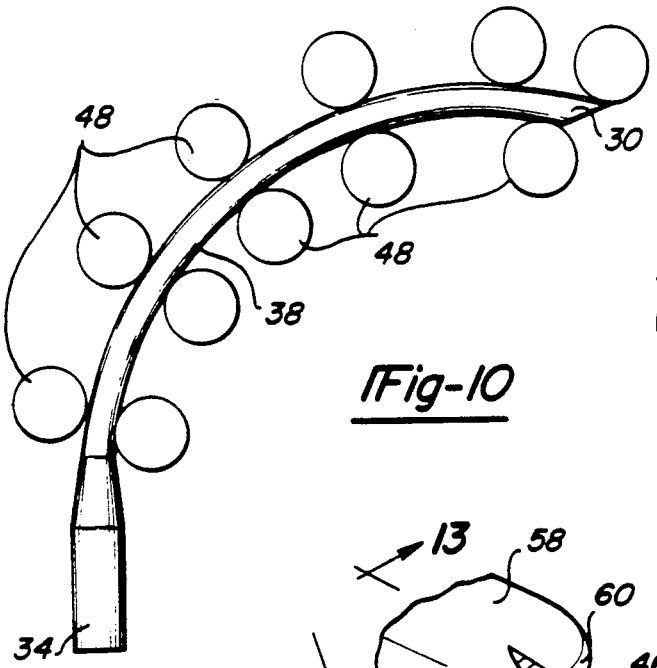
FIG. 10 is a back elevational view of the backpack of FIG. 8.

When closed, pack 110 is also similar in general appearance to ordinary (non-garment containing) backpacks, but, in contrast to pack 10, is provided with a relatively sloped shoulder portion 112, as seen in FIG. 10. Thus pack 110 necessarily has a smaller internal volume than pack 10, assuming all dimensions other than those of the shoulder area are identical. Accordingly, this embodiment of pack 110 may be more suitable for wearers of younger age or smaller frame, or others who prefer to or should carry only smaller, lighter loads.

Pack 110 has a front panel 114 completely surrounded by a continuous zipper 116 which is provided with identical tabs 118 (rather than a single tab as in pack 10) at opposed ends thereof. Tabs 118 meet centrally at the bottom of front panel 114 when zipper 116 is in closed position and permit opening of zipper 116 to either the left or right of the wearer. Dual tabs 118 also permit the wearer to avoid the inconvenience of having to re-thread the zipper end when it is desired to be closed. If necessary, the back of the garment may be adapted slightly, for example, by adding a short central slit at the bottom edge of the back of the jacket, to accommodate variations in the zipper structure.

Attached outwardly of each closed zipper tab 118 on front panel 114 are ends 121 of adjustment straps 122, which straps are preferably formed of nylon web or other similar material.

Adjustment straps 122 each terminate outwardly in a free end 124 which is threadedly connected to an adjustment buckle 126. Adjustment buckles 126 are each also connected to outer ends 128 of preferably padded shoulder straps 130. Straps 130 extend upwardly and terminate in ends 132 which connect as by stitching to front panel 114. The connection of ends 132 to panel 114 is supported by a reinforcing member 134 which is similar in structure to that previously described in regard to pack 10. An optional suspension loop 136 extends between and terminates in opposed ends 138 which preferably connect beneath reinforcing member 134 near the top of front panel 114 either between or beneath respective ends 132 of shoulder straps 130. As in the previous embodiment, other strap and buckle constructions will suffice. It is critical, however, that the shoulder straps 130 and adjustment straps 122 be affixed to front panel 114 inward of zipper 116, in order to allow access to and proper function thereof, as described hereafter.

Front panel 114 is connected along its entire perimeter by zipper 116 to a front edge 141 of a central panel 140 which extends continuously around pack 110 substantially perpendicularly to front panel 114, and includes right side wall 142, which extends upwardly into top wall 144, which in turn continues in gradually upward, then downward, angled, transverse fashion across the top of pack 110 forming sloped shoulder portions 112, and then flows downwardly into left, side wall 146 which in turn continues into bottom wall 148, which latter extends transversely, until flowing into right side wall 142 (FIG. 10).

Identical paired zippers 150 connect approximately the top half of central wall 140 along back edge 143 thereof to approximately the top half of a back wall 154 along the upper portion of the perimeter thereof. Back panel 154 is desirably substantially the same in size and shape as front panel 114 and is normally disposed approximately parallel thereto. Zippers 150 when closed preferably meet centrally upward on back wall 154 and terminate there in pull tabs 152. Zippers 150 each extend downward to a corresponding lower end 151. A preferably stitched seam 156 extends between the two zipper ends 151 to continue the connection therealong of the approximate lower half of back or rear panel 154 at the lower perimeter thereof to the approximate lower half of central panel 142 along a lower portion of edge 143.

So connected, front panel 114, central panel 140 and back panel 154 generally define the outside of a container for books or other bulky or heavy objects. Of course, slight variations in the above structure are conceivable which would not affect the function of the invention. For example, paired zippers 150 may be replaced with a single, longer zipper for access to the book compartment.

Optionally attached to the lower outside of back panel 154 is a small pocket, generally designated 160 for containing pens, hand held calculators and the like. Pocket 160 is selectively connected around the entire perimeter thereof to back panel 154 by a zipper 158 which extends between and terminates in two identical pull tabs 159.

Pen pocket 160 includes a lower pouch portion 162 connected by a surrounding zipper 166 to a top or cover portion 164 in similar manner as described in regard to the first embodiment. However, unlike zipper 66 of pocket 62, zipper 166 in this version is not covered by a flap but remains exposed so as to be more easily accessible.

The internal construction of pack 110 is identical in all important aspects to that of pack 10, and thus has not been shown or discussed in detail, but includes a channel-like encasement or storage pouch, accessible via zipper 116, for holding garment 174 internally of central panel 142 when garment 174 is not being worn.

Figure 11:
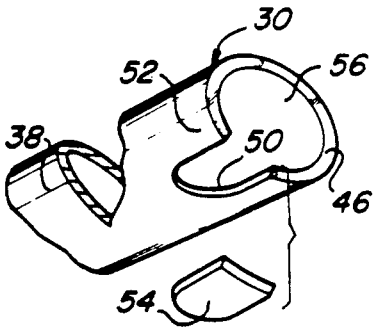
FIG. 11 is a side elevational view of the backpack of FIG. 8 showing the garment in wearing position.
Figure 12:
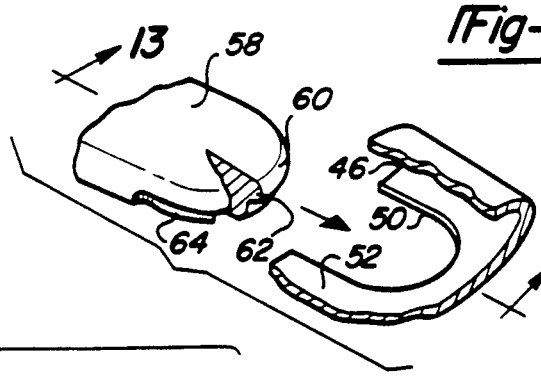
FIG. 12 is a front elevational view of the garment of the backpack FIG. 11.
Figure 13:
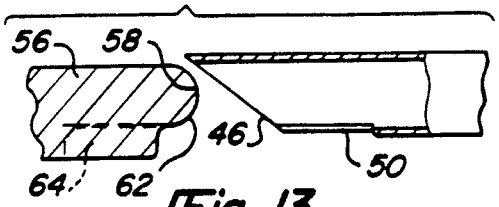
Figure 14:
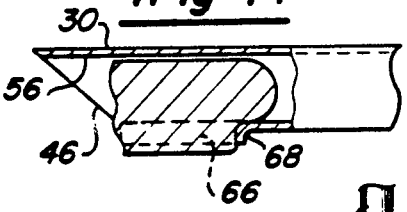
Figure 15:
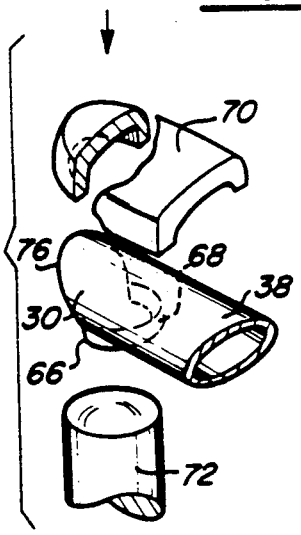
Figure 16:
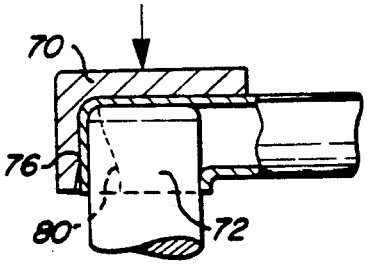
Figure 17:
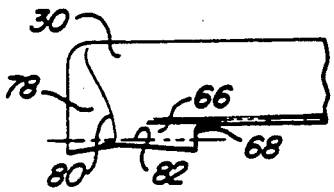
Figure 18:
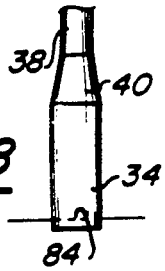
Figure 19:
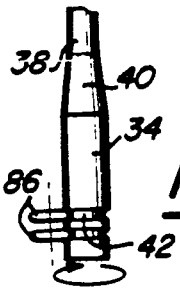
Figure 10:
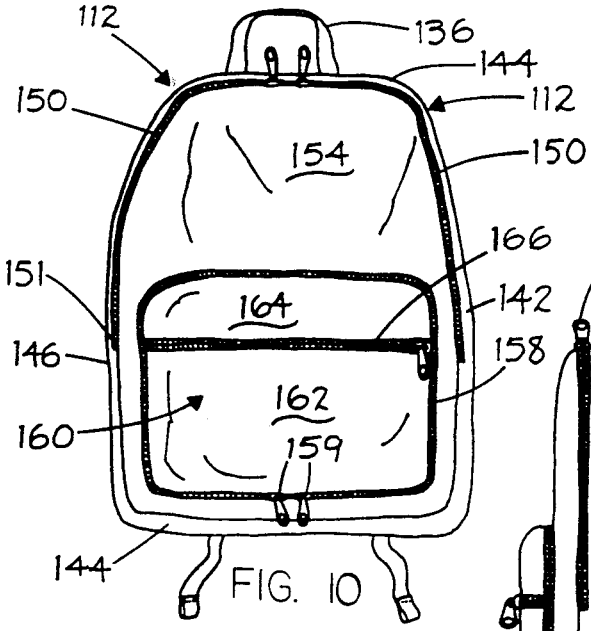
Figure 11:
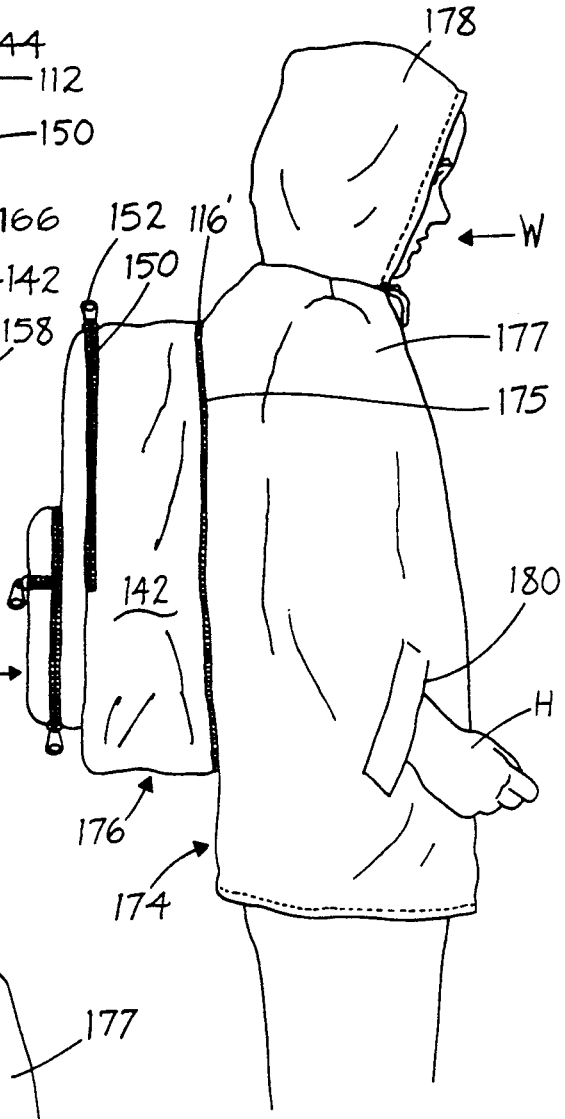
Figure 12:
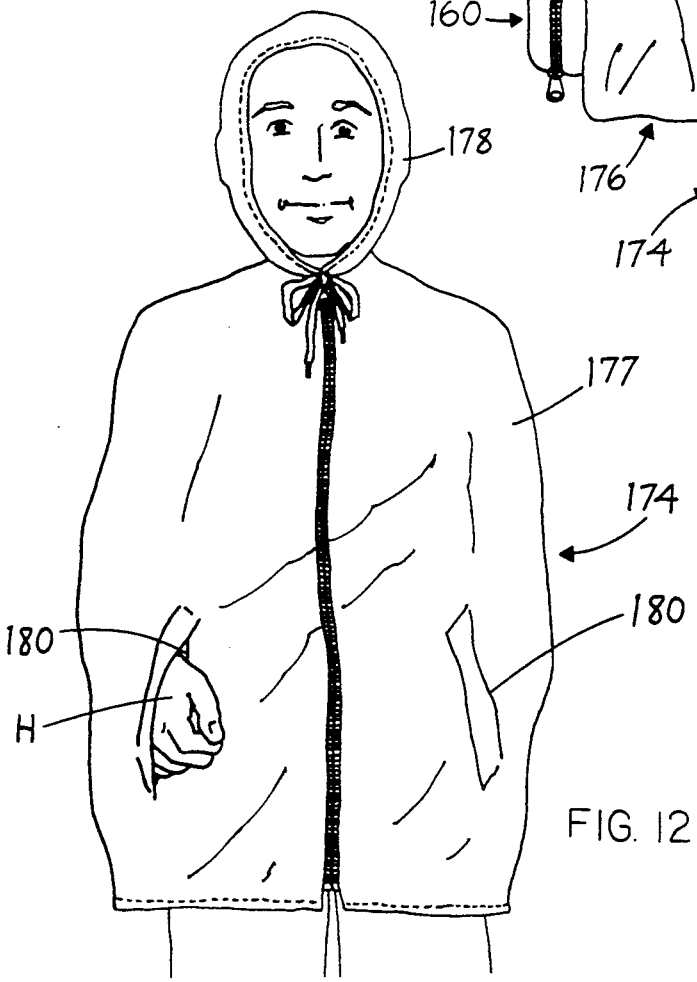

FIGS. 11 and 12 schematically illustrate garment portion 174 externally of container portion 176 of pack 110 in operable position on a wearer W. Garment 174 is preferably provided so as to have a cape or poncho-like body portion 177, an optional but preferred hood 178, and slits 180 for exit of wearer W's hands H.

Backpack portion 176 and garment portion 174 are preferably constructed of a light-weight flexible materials which are at least water-resistant, if not completely waterproof.

In operable position as shown in FIG. 11, only one zipper track 116' is visible and support straps 130 are completely hidden from view (FIGS. 11 and 12). As in the previous embodiment, a preferably single, continuous seam 175 simultaneously connects zipper track 116' and the back of garment portion 174 to the forward edge 141 of central panel 140, such that front panel 114 effectively serves as part of the back of garment 174 when garment 174 is in normal wearing position.

In use, it is a simple matter for the wearer of either pack 10 or 110 to merely reach rearwardly and grasp zipper tabs 18, or 118, and release zipper 16, 116, thereby allowing removal of the garment from the tubular encasement within the pack for either slipping over the shoulders or placement of the arms through sleeves and closing the garment as desired. It may be readily seen that if structured with shoulder or adjustment straps attached substantially differently than as described, this easy access to the garment would not be possible. For example, connection of strap ends 21, 32 to bottom panel 48 or top panel 44, respectively, rearward of zipper 16 would interfere with withdrawal of garment 74 from pouch 68 unless pack 10 was completely removed from the wearer's shoulders.

The described structure has obvious advantages over the prior art, as a sudden chill or downburst can be dealt with simply and quickly by the wearer alone or, if desired, with the assistance of another; in either case, without even partial removal of the pack portion from the body. This feature is unknown in the prior art which, in all cases of combined garment and pack, requires taking the pack off and disassembling or reassembling same in order to remove the garment, put it on and then replace straps over the wearer's garmented shoulders. Such a structure completely eliminates the possibility of the second embodiment described, because the cape-like garment therein is not amenable to use with shoulder straps, and has great disadvantages when compared to the first embodiment, as previously discussed.

Also, if the wearer of the new backpack wishes to remove the garment quickly (even, for example, while hiking along) it is a simple matter to remove it from the arms and shoulders and thereafter when desired remove the entire pack from the shoulders and quickly replace the garment in the storage pouch. If desired, for example if the garment is damp, it can be draped backward over the pack portion to dry without interfering with wearing of the container portion. Thereafter, the garment is easily folded or crumpled into the storage compartment by the wearer of the backpack, or with the pack still in wearing position, with a little help from another person.

Moreover, the structure of the new convertible backpack garment is extremely strong and adapted for extended useful wear because no weight is required to be supported by the garment itself or any connections thereof to the pack. Rather, as shown and described, the weight of the container portion is suspended from the wearer's shoulders by support straps which, contrary to the prior art, are entirely covered and protected from the elements when the garment portion is in wearing (or "unstored") position.

Furthermore, the structure of the new convertible backpack/garment completely eliminates the problem of the sleeves, shoulders or back of a garment becoming uncomfortably bunched beneath the shoulder straps, because the garment is applied over the straps, rather than vice versa. This also eliminates the need to adjust the length of the straps to accommodate the extra bulk of a garment therebeneath.

Of course, it is also conceived that the important features of the new convertible backpack/garment may be readily adapted for packs of a heavier construction, such as internal and external frame-supported packs used by wilderness campers, mountain climbers and the like. In those cases, the integral garment may be provided with down or synthetic insulation for greater warmth.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A backpack having an integral garment which may be donned by a wearer of the backpack without removal thereof, the backpack comprising:

(a) A container portion including a front panel having a perimeter, a central panel having a continuous front edge and a continuous rear edge, and a rear panel having a perimeter, the central panel intersecting and connecting the front panel and the rear panel and forming therebetween top, first and second side and bottom external walls, the front panel further having a plurality of straps connected thereto for support of the backpack from the wearer's shoulders;

(b) means for releasably connecting the front panel to the central panel;

(c) a garment portion integrally connected to the container portion; and (d) means for storing the garment portion in the container portion in such manner that the garment can be selectively donned by the wearer without removal of the container portion from the wearer's shoulders and with the garment at all times remaining in integral relationship with the backpack.

2. The backpack of claim 1, wherein the means for storing the garment portion is an openable tubular shaped storage compartment which extends continually internally along the inside of the central panel of the container portion for storage therein of the garment when the garment is not being worn.

3. The backpack of claim 2, wherein the means for selectively releasably connecting the front panel to the central panel is a zipper having first and second intermeshing tracks, the zipper being connected coextensively along the first track to the entire perimeter of the front panel, and being connected simultaneously and coextensively along the entire second track to the back of the garment portion and to the front edge of the central panel to thereby provide access to the storage compartment by the wearer for removal of the garment from the storage compartment and donning of the garment by the wearer without removal of the container portion from the wearer's shoulders.

4. The backpack of claim 3, wherein the tubular storage compartment is defined by an internal wall connected coextensively with and inside of the central panel within the container portion, the internal wall having forward and rearward edges, and being connected entirely along the forward edge thereof to the perimeter of the front panel, and the internal wall also being connected entirely along the rearward edge thereof to the rearward edge of the central panel, to thereby form the tubular storage compartment within the container portion of the backpack for storage therein of the integral garment and further to provide selective access to the storage compartment via the zipper connecting the front panel to the central panel.

5. The backpack of claim 1, and further comprising an openable pouch connected to the rear wall of the container portion for storage therein of small, loose objects, separately from the inside of the container portion.

6. The backpack of claim 1, wherein the container portion and the garment portion are formed of water-resistant flexible material.

7. The backpack of claim 1, wherein the container portion is provided with a substantially square shoulder portion.

8. The backpack of claim 1, wherein the container portion is provided with an upwardly sloped shoulder portion.

9. The backpack of claim 3, wherein the zipper is provided on each opposed end thereof with a pull tab so as to be operable either to the left or the right of the wearer.

10. The backpack of claim 1, wherein the garment portion is a hooded, long-sleeved jacket.

11. The backpack of claim 1, wherein the garment portion is a hooded cape having slits for selective passage therethrough of the hands of the wearer.

12. The backpack of claim 1, wherein the front panel is provided with upper and lower edges and extends therebetween and further wherein the support straps are provided with upper ends fixed to the front panel substantially centrally adjacent to the upper edge thereof, and further wherein the backpack has adjustment straps connecting the support straps to the front panel for selective longitudinal adjustment thereof as required by the particular wearer.

13. The backpack of claim 12, wherein the support straps are padded for comfort and are attached to the adjustment straps by buckles which facilitate selective adjustment of the adjustment straps by the wearer.

* * * * *

UNITED STATES PATENT AND TRADEMARK OFFICE

CERTIFICATE OF CORRECTION

PATENT NO. : 5,165,111

DATED : November 24, 1992

INVENTOR(S) : Richard A. Lieberman

It is certified that error appears in the above-identified patent and that said Letters Patent is hereby corrected as shown below:

In the drawings, sheet 4 of 5 should be deleted to be replaced with the attached sheet, consisting of figures 7-9.

Signed and Sealed this

Twenty-third Day of November, 1993

*Attest:*

Bruce Lehman

BRUCE LEHMAN

*Attesting Officer*

*Commissioner of Patents and Trademarks*